US006895687B2

(12) United States Patent
Resch et al.

(10) Patent No.: US 6,895,687 B2
(45) Date of Patent: May 24, 2005

(54) DRIER FOR CONTINUOUS FLOW DRYING OF FOOD PRODUCTS

(75) Inventors: Heinz Resch, Flawil (CH); Hermann Zwyssig, Niederuzwil (CH)

(73) Assignee: Buhler AG, Uzwil (CH)

( * ) Notice: Subject to any disclaimer, the term of this patent is extended or adjusted under 35 U.S.C. 154(b) by 0 days.

(21) Appl. No.: 10/496,372

(22) PCT Filed: Sep. 20, 2002

(86) PCT No.: PCT/CH02/00521

§ 371 (c)(1),
(2), (4) Date: Oct. 28, 2004

(87) PCT Pub. No.: WO03/046454

PCT Pub. Date: Jun. 5, 2003

(65) Prior Publication Data

US 2005/0050753 A1 Mar. 10, 2005

(30) Foreign Application Priority Data

Nov. 30, 2001 (DE) ..... 101 58 446

(51) Int. Cl.[7] ..... F26B 15/14
(52) U.S. Cl. ..... 34/209; 34/225
(58) Field of Search ..... 34/134, 189, 197, 34/209, 225, 231; 99/475, 477

(56) References Cited

U.S. PATENT DOCUMENTS

| | | | | |
|---|---|---|---|---|
| 2,272,007 | A * | 2/1942 | James | 425/314 |
| 3,468,036 | A * | 9/1969 | Blaettler | 34/443 |
| 4,331,690 | A * | 5/1982 | Bradshaw | 426/233 |
| 4,354,549 | A * | 10/1982 | Smith | 165/62 |
| 4,750,276 | A * | 6/1988 | Smith et al. | 34/612 |
| 5,193,440 | A * | 3/1993 | Frank | 99/330 |
| 6,021,709 | A * | 2/2000 | Koopman et al. | 99/476 |
| 6,365,210 | B1 * | 4/2002 | Schaible et al. | 426/94 |

* cited by examiner

*Primary Examiner*—Stephen Gravini
(74) *Attorney, Agent, or Firm*—Bachman & LaPointe, P.C.

(57) ABSTRACT

A drier for continuous flow drying of food products, especially pasta, inside the drier with adjustable and/or conditioning zones along the continuous flow path of the product. The inside of the drier can be accessed by a maintenance technician and the respective horizontal segments of the side walls are sub-divided perpendicular to the direction of the continuous flow from top to bottom into respectively at least two vertical segments which are respectively curved in an outer direction and which can also be moved away from the housing in an independent manner, enabling the maintenance technician to have access to the inside from the respective point of a vertical segment moved away from the housing.

22 Claims, 5 Drawing Sheets

DRIER FOR CONTINUOUS FLOW DRYING OF FOOD PRODUCTS

BACKGROUND OF THE INVENTION

The invention relates to a dryer for the continuous flow drying of food products, in particular dough articles, along a continuous flow path of the product inside the dryer with adjustable and/or air-conditioning zones along the continuous flow path of the product, whereby the dryer has an insulating housing with side walls curved in an outer direction, which are divided along the substantially horizontal flow path of the product in each case into individual horizontal segments or longitudinal segments, which can be moved from their sealing locking position away from the housing independently of one another, such that the dryer interior is accessible for a maintenance technician.

Such dryers, in particular for dough articles, are known and have successfully been used for years in the food industry, in particular the dough industry.

In these known dryers the side doors or flaps which are designated as curved panels, and which enable access to the inside of the dryer, extend from the ceiling area to the floor area over the entire height of the dryer housing. The flaps normally articulated at their upper horizontal edge to the dryer housing are accordingly difficult to handle on account of their size and weight. On the one hand considerable force must be applied by a maintenance technician wanting to gain access to the inside of the dryer to raise the flaps and pivot them outwards, and on the other hand to tilt the flaps by a considerable angle from the dryer housing, in order to have adequate room to enter the dryer. A further disadvantage of the large flaps is their absolute distortion due to their size on account of changes in temperature. With curved flaps having a given deflexion a rise in temperature and the resulting longitudinal expansion in the case of a closed flap leads to a noticeable increase in deflexion, which in many cases results in sealing problems of the dryer door or curved panel. These sealing problems could be solved by correspondingly large seals deformable over wide areas, yet the problem of heavy and inconvenient handling remains unsolved when it comes to opening and closing.

The object of the invention therefore is to provide a dryer of the type initially outlined whose doors or curved panels enable easy handling and good ergonomics for a maintenance technician, who might want to access the inside of the dryer, and also have minimal susceptibility to sealing problems during changes in temperature.

SUMMARY OF THE INVENTION

The foregoing object is achieved by providing a dryer wherein the respective horizontal segments or longitudinal segments of the side walls are divided perpendicularly to the flow path of the product from top to bottom in each case into at least two vertical segments, which in each case are curved in an outer direction and can be moved away from the housing likewise independently of one another, so that the maintenance technician has access to the dryer interior at any place in a vertical segment moved away from the housing. Due to this vertical subdividing of the horizontal segments into lower and upper vertical segments the weight and dimensions of the flaps formed by the vertical segments are reduced, so that easier handling of the flaps is enabled when the dryer housing is opened and closed, this on account of the lower weight and reduced bulk. Due to the minimal dimensions temperature-related deformation and associated changes in the deflexion of the curved flaps are less strongly pronounced and can be well compensated by the elastic seals between the flaps and the dryer housing. In this way the sealing problems of the prior art are also solved.

On the outside of the housing wall a floor area accessible for the maintenance technician is preferably assigned to each movable vertical segment of the housing wall, where in particular at least some of the vertical segments adjoining one another along the flow path of the product are assigned an accessible floor area. This accessible floor area is e.g. the very floor on which the dryer itself stands, or a floor area in the form of a gallery or balcony, attached to the dryer housing for upper dryer stages. This obviates painstaking and frequently dangerous climbing on the upper dryer stages by means of ladders or similar accessories.

The vertical segments housing are effectively linked to the dryer in the form of hinges and can be pivoted away from the housing. The hinge-like links can be provided with a pressure point, so that when the vertical segments are pivoted away a growing positive force must be applied, until a negative force supports further pivoting after a maximum positive force is overcome. Such a pressure point is particularly advantageous when the vertical segments are pivoted away upwards. In this case the vertical segments or curved panels pivoted upwards remain without additional support in their open position.

The outwards projecting bulging of the side walls or vertical segments is preferably one-dimensional bulging with linear generatrix. Here the one-dimensional bulging of the vertical segments can on the one hand be configures such that the linear generatrix of the bulged surface are parallel to the flow path of the product and the hinge-like linking is arranged on the upper edge of the vertical segments with an axis of rotation running parallel to the linear generatrix, so that the vertical segments can be pivoted away upwards as a "flap". On the other hand the one-dimensional bulging of the vertical segments can also be configures such that the linear generatrix of the bulged surface are orthogonal to the flow path of the product, and the hinge-like linking is arranged on a side vertical edge of the vertical segments with an axis of rotation running parallel to the linear generatrix, so that the vertical segments can be moved away sideways as a "door".

The vertical segments are effectively pressed by at least one tightening strap in their closed position onto the housing in the manner of a seal, whereby the tightening strap or the tightening straps lie on the outside of each vertical segment and the linear generatrix of the bulging of the vertical segment cross orthogonally.

In a particularly preferred design there is arranged in the area of the subdivision of the respective horizontal segments from top to bottom between the lower curved vertical segment and the upper curved vertical segment in each case a substantially vertical, preferably even wall area. Due to this particular measure the maximum width of the dryer housing is reduced and an approximately rectangular cross-section of the dryer housing is produced running perpendicularly to the flow path of the product. This is ergonomically prudent, since access to and servicing of the upper vertical segment is made much easier.

The dryer interior is possibly and preferably best subdivided into an upper dryer interior and a lower dryer interior at the level of this substantially vertical wall area.

A separate dryer air-conditioning can be adjustable in the upper dryer interior and the lower dryer interior in each case. To adjust the dryer air-conditioning the temperature and the humidity of the dryer interior must be varied. This is done by supplying power and draining material e.g. via piping and drains for steam, electricity and dry or moist hot air. A mounting area can extend either laterally along the dryer and/or above each vertical segment along the dryer for such diverse supply pipes. In this way the dryer is supplied from above, effectively reducing the number of supply pipes in the floor area and side region of the dryer housing.

The power supply or material drainage is effected preferably centrally via the front surfaces or front sides of the dryer.

The accessible floor area is effectively designed as a gallery on the outside of a housing wall assigned to every movable vertical segment at least for the upper vertical segments of the housing wall (upper dryer stages). The use of platform lifts or ladders for access to the upper dryer stages is accordingly superfluous.

The gallery-like floor area is preferably mounted on bearers, which project sideways from the dryer, whereby the bearers preferably extend transversely to the flow path of the product. These bearers extending transversely from the dryer are preferably arranged between the upper and the lower curved vertical segment. These bearers preferably project out on both side walls, and extending along both side walls of the dryer is an accessible floor area or mezzanine supported on these protruding bearers.

This gallery-like floor area is in addition effectively borne by connecting rods from above, which are attached in particular to cross-beams at the upper end, that is, on the "roof" or ceiling area of the dryer.

In addition to the gallery-like floor area for the upper dryer stages the roof of the dryer can also have an accessible floor area ("roof garden"). In addition, the dryer according to the present invention can be enclosed on several stages by accessible floor areas, which are interconnected via fixed steps, whereby the connecting rods, by which the floor areas are suspended on the cross-beams in the ceiling area of the dryer, effectively form a railing for the gallery floor area together with crossbars, which extend horizontally along the dryer and cross the vertical connecting rods.

BRIEF DESCRIPTION OF THE DRAWINGS

Further advantages, characteristics and application options of the invention will emerge from the following description of a preferred embodiment with reference to the diagram, in which.

DETAILED DESCRIPTION

Figure 1:
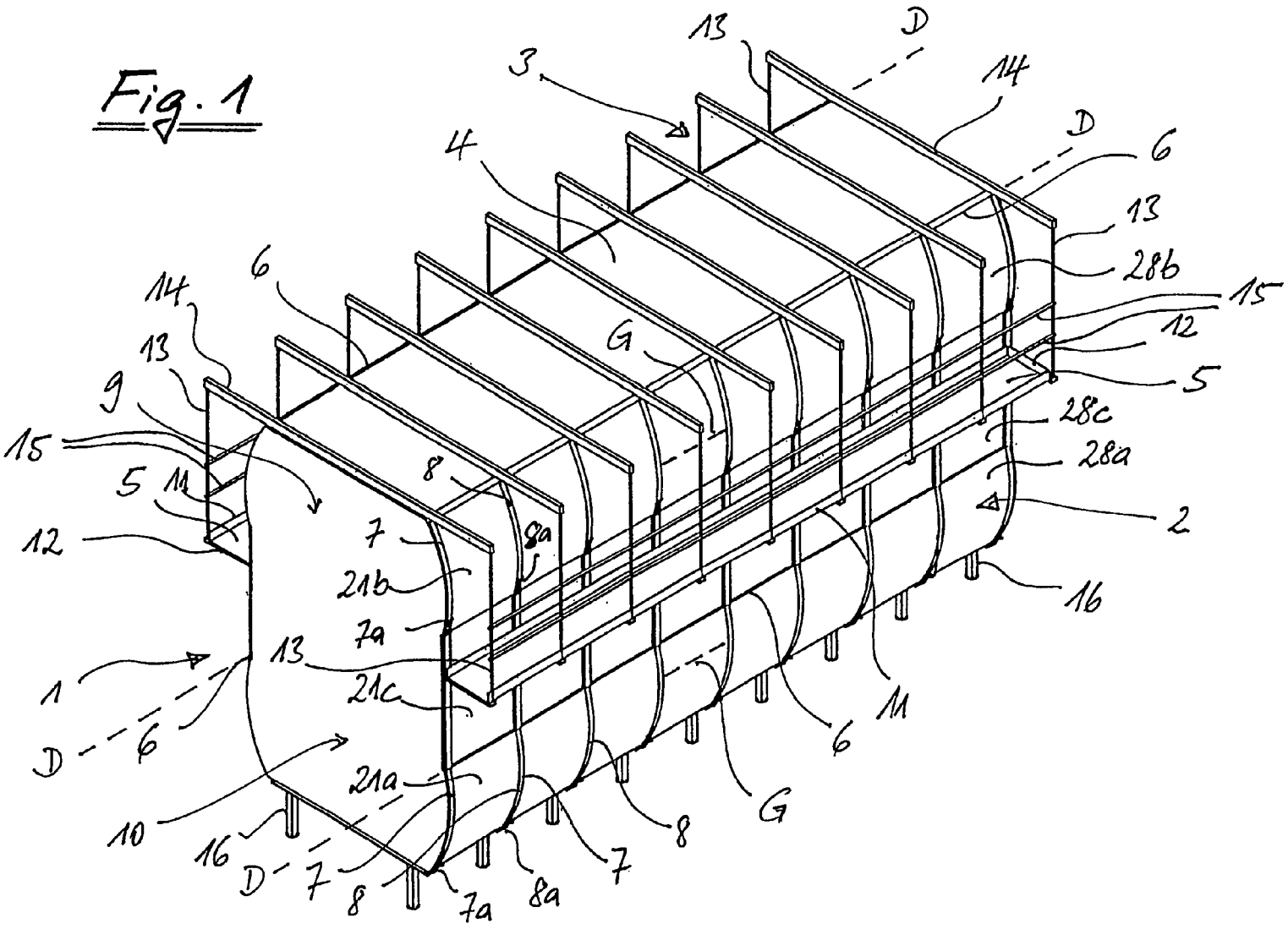
FIG. 1 is an oblique perspective view from above of the dryer according to the present invention.

The dryer shown in an oblique perspective view from above in FIG. 1 has an insulating housing with side walls 2, 3 curved in an outer direction as well as flat front faces on each end of its longitudinal expansion. The dryer housing stands on feet 16, which ensure spacing from the floor. The side walls 2, 3 are partly bulged and curved in an outer direction, whereas the ceiling area 4 and the floor area of the dryer are designed substantially flat. The front and rear front face of the dryer illustrated in the figure can be configured as front and rear cutting plane by a dryer according to the present invention of any length, whereby for example eight horizontal segments 21, 22, . . . 28 forming the side wall 2, as well as eight horizontal segments 31, 32, . . . 38 forming the side wall 3, are illustrated between both cutting faces.

The horizontal segments 21 to 28 (see FIG. 4) of the right side wall 2 and the horizontal segments 31 to 38 (see FIG. 4) of the left side wall 3 are also divided in each case along the vertical direction into three different segments. Each horizontal segment 21 to 28 of the left side wall 2, as well as each horizontal segment 31 to 38 of the right side wall 2 is divided in each case into a lower vertical segment 21*a*, 22*a*, . . . 28*a* or 31*a*, 32*a*, . . . 38*a* curved in an outer directions as well as into an upper vertical segment 21*b*, 22*b*, . . . 28*b* or 31*b*, 32*b*, . . . 38*b*, between which is located in each case a middle flat area 21*c*, 22*c*, . . . 28*c* or 31*c*, 32*c*, . . . 38*c*. The underlying vertical segments 21*a* to 28*a* or 31*a* to 38*a* are in each case assigned to a dryer interior 10, whereas the superposed vertical segments 21*b* to 28*b* or 31*b* to 38*b* are assigned to an upper dryer interior 9. At the level of the flat areas 21*c* to 28*c* or 31*c* to 38*c* of the side wall 2 or 3 of the dryer an air-conditioning separation plant 18 (see FIG. 2) is preferably arranged, which separates the lower dryer interior 10 from the upper dryer interior 9.

The lower vertical segments 21*a* to 28*a* and the upper vertical segments 21*b* to 28*b* of the right side wall 2 and the lower vertical segments 31*a* to 38*a* and the upper vertical segments 31*b* to 38*b* of the left side wall 3 are designed as access doors or access hatches, which are linked in each case to the dryer housing at their upper edge 6 (see FIG. 2) about axes of rotation D (FIG. 1). In this way the lower and upper vertical segments of the left and right side wall 2, 3 of the dryer housing can swivel outwards (see FIG. 5) and thus enable access to the dryer.

Each of the vertical segments which can pivot upwards has a left tightening strap 7 and a right tightening strap 8, at the lower end of which in each case a tensioning device 7*a* or 8*a* is attached. The vertical segments can be fixed in their locked position using this tensioning device. On closing each vertical segment is swung downwards, and the tensioning device 7*a* or 8*a* is suspended on the dryer housing, after which a lever of the tensioning device 7*a* or 8*a* is shifted to tense the tightening strap 7 or 8 and each vertical segment is pressed against the dryer housing in the manner of a seal via such tensing.

Figure 2:
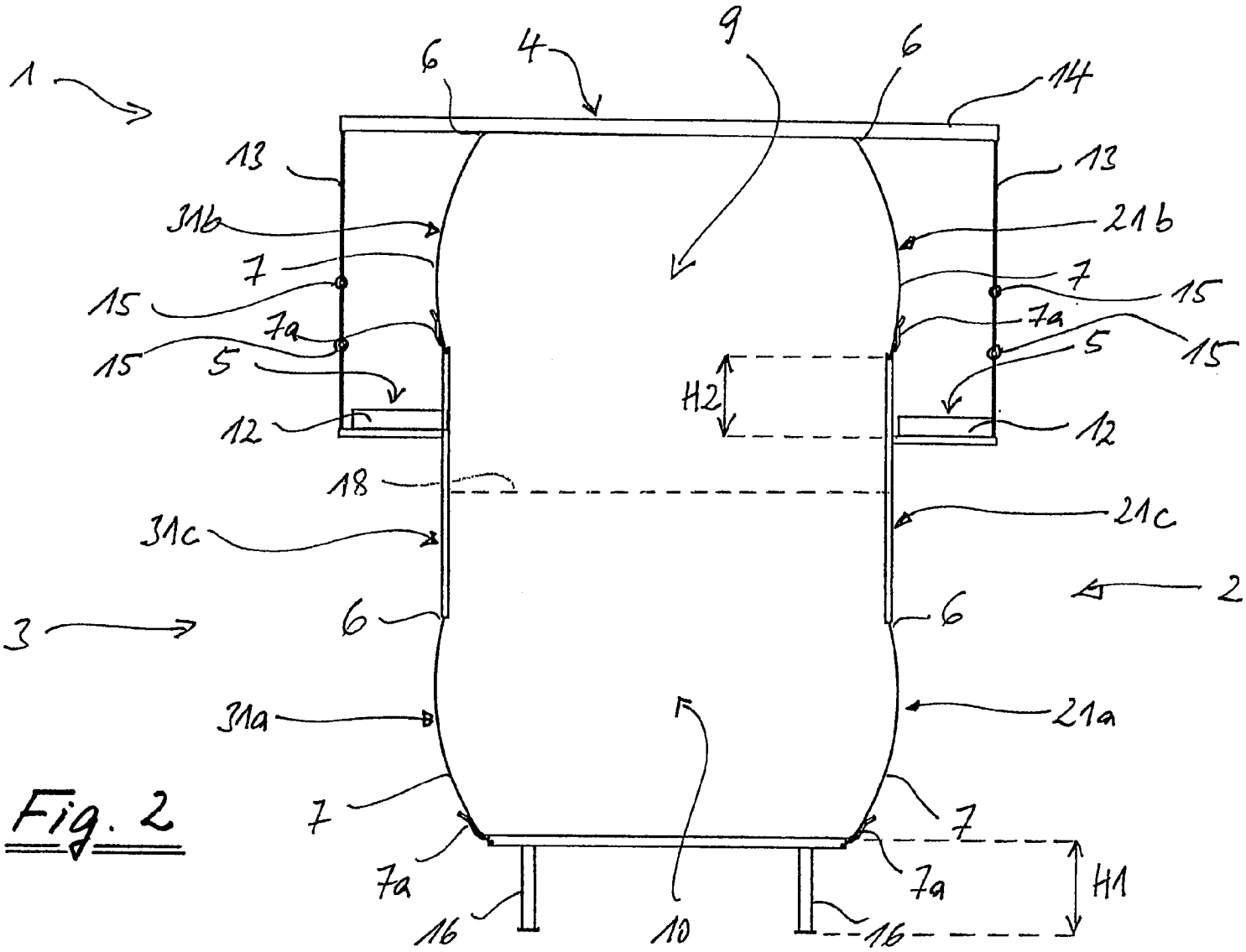
FIG. 2 is a view of the front face of the dryer according to the present invention.

All vertical segments 21*a* to 28*a*, 21*b* to 28*b*, 31*a* to 38*a* and 31*b* to 38*b* are curved one-dimensional and form a curved surface, which results from displacing a linear generatrix G along a curved path, whereby the curved path corresponds to the appearance of the vertical segments 21*a*, 21*b*, 31*a* and 31*b* von FIG. 2. The tightening straps 7 and 8 of each vertical segment run perpendicularly to the generatrix G of each vertical segment.

The lower vertical segments 21*a* to 28*a* and 31*a* to 38*a* of the right or left side wall 2, 3 of the dryer can be accessed via the floor, on which the dryer is set with its feet 16, without further effort. So that the upper vertical segments 21*b* to 28*b* and 31*b* to 38*b* of the right or left side wall 2, 3 of the dryer are likewise easily accessible, an additional floor area or mezzanine 5 is provided, which extends from the flat areas 21*c* to 28*c* and 31*c* to 38*c* of the right or left side wall 2, 3 of the dryer perpendicularly in a horizontal direction in the manner of a balcony. This balcony-like or gallery-like floor area 5 lies on horizontal bearers 12, which are in each case arranged divided horizontally over the entire longitudinal direction of the dryer. These bearers 12 are in each case of a certain length which corresponds to the width of the floor area 5. The floor area 5 resting on the bearers 12 is held by vertical connecting rods 13, which extend between each bearer 12 and a cross-beam 14 assigned thereto in the ceiling area of the dryer. Accordingly, the load acting on the floor area 5 (intrinsic weight plus people and maintenance tools) is transferred via the lower cross-beams 12 and the upper cross-beams 14 evenly to the dryer housing. For safety the vertical connecting rods 13 are connected to two horizontal crossbars 15, extending over the entire length of the dryer. In this way a railing for the accessible floor area is formed by the vertical connecting rods and the horizontal crossbars 15.

FIG. 2 is a view of the front face of the dryer according to the present invention. All reference numerals of FIG. 1 were retained for corresponding elements in FIG. 2. The figure shows the form of each one-dimensional bulging of the vertical segments 21*a*, 21*b*, 31*a* and 31*b*. Together with the flat areas 21*c* and 31*c* of the right side wall 2 or the left side wall 3 a substantially rectangular cross-section, that is, a substantially rectangular front face of the dryer is obtained with the respective superposed and underlying vertical segments, whereby there is minimal deviation from the rectangular shape only in the area of the vertical segments. Compared to the form of the dryer of the prior art (see FIG. 5*a*) an overall better approximation of the rectangular shape results from the present invention (see FIG. 5*b*), ensuring better usage of the dryer interior. An added advantage of the flaps formed by the vertical segments and relatively small compared to the prior art is that due to the constant fluctuations in temperature on the housing there is minimal temperature-related absolute change in length of the vertical segments. Because the vertical segments are tightly gripped on the dryer housing when in the closed state, a change in deflexion of the vertical segments also takes place with changes in temperature. The smaller the dimensions of these vertical segments, the smaller the change in deflexion of these vertical segments. These relatively small changes in deflexion of the vertical segments can be compensated anyway by standard seals placed between the vertical segments and the dryer housing, by means of which in the dryer according to the present invention the sealing problems common in the prior art are minimised. The lesser weight of the smaller flaps according to the present invention formed by the vertical segments is put forward here as an added advantage relative to the large flap extending over the entire dryer height. This alleviates handling whenever the flaps are opened and closed by a maintenance technician.

The height H1 between the floor and the lower horizontal edge of the lower vertical segments 21*a* or 31*a* corresponds approximately to the height H2 between the floor area 5 of the balcony-like or gallery-like suspension and the horizontal under-edge of the vertical segments 21*b* or 31*b*. The floor area 5 has a width, such that the upper vertical segments 21*b* and 31*b* can be pivoted away from the dryer housing far enough. This permits comfortable access to the open dryer.

Figure 3:
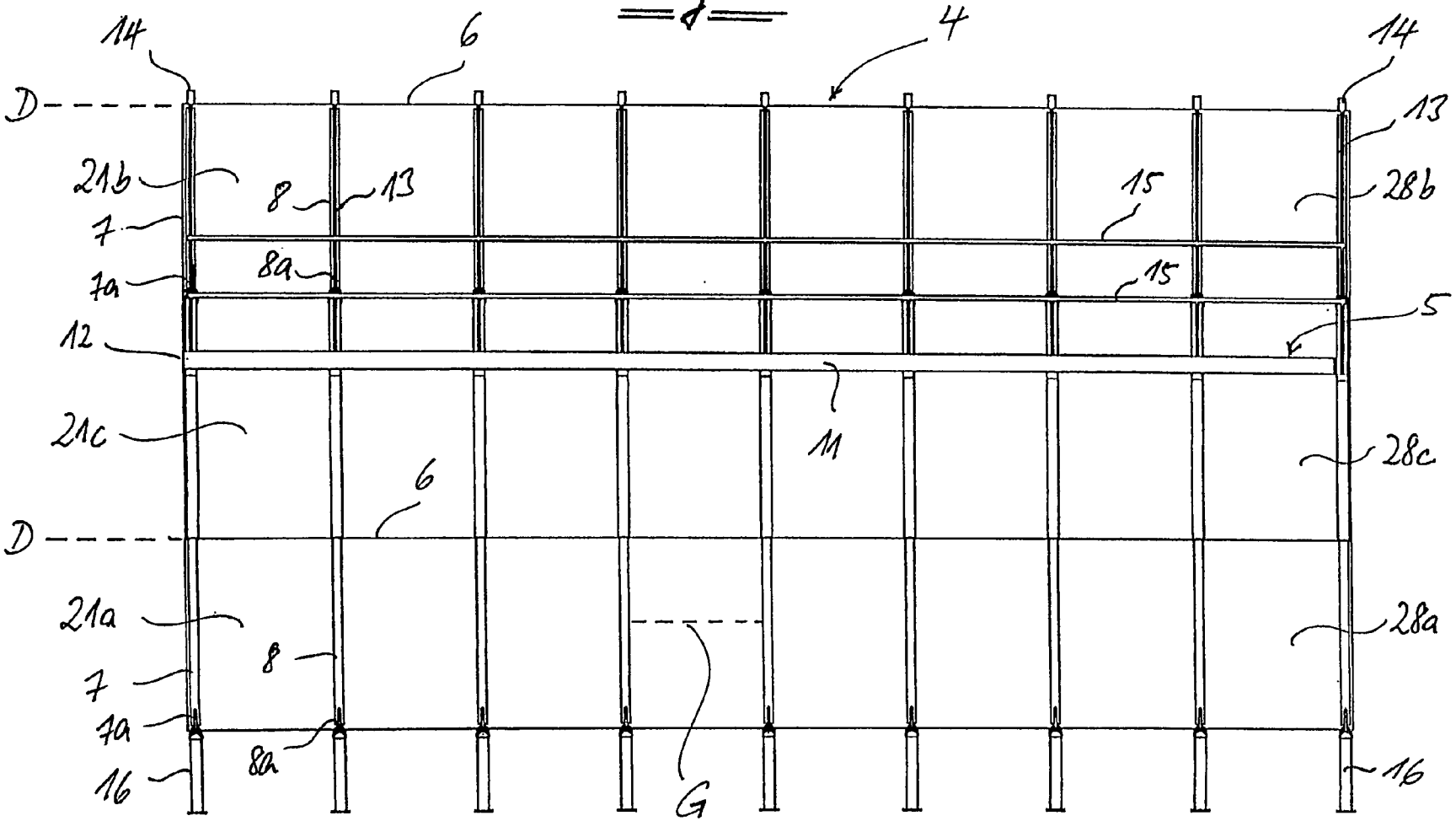
FIG. 3 is a view of the lateral face of the dryer according to the present invention.

FIG. 3 is a view of the side faces of the dryer according to the present invention. FIG. 3 illustrates only the side wall 2, yet the opposite side wall 3 is preferably designed symmetrically thereto. Also, the same reference numerals were used here for all elements, as in FIGS. 1 and 2. The vertical segments 21*a* to 28*a* as well as 21*b* to 28*b* appear rectangular in their projection of the side elevation. The ceiling area 4 of the dryer is designed flat. The tightening straps 7 and 8 the respective upper vertical segments 21*b* to 28*b* are partially covered by the vertical connecting rods 13, which extend between the cross-beams 14 at the level of the ceiling area 4 and the cross-beams 12 at the level of the floor area 5. Together with both horizontal crossbars 15 these vertical connecting rods 13 form the railing for the balcony-like or gallery-like floor area 5.

Figure 4:
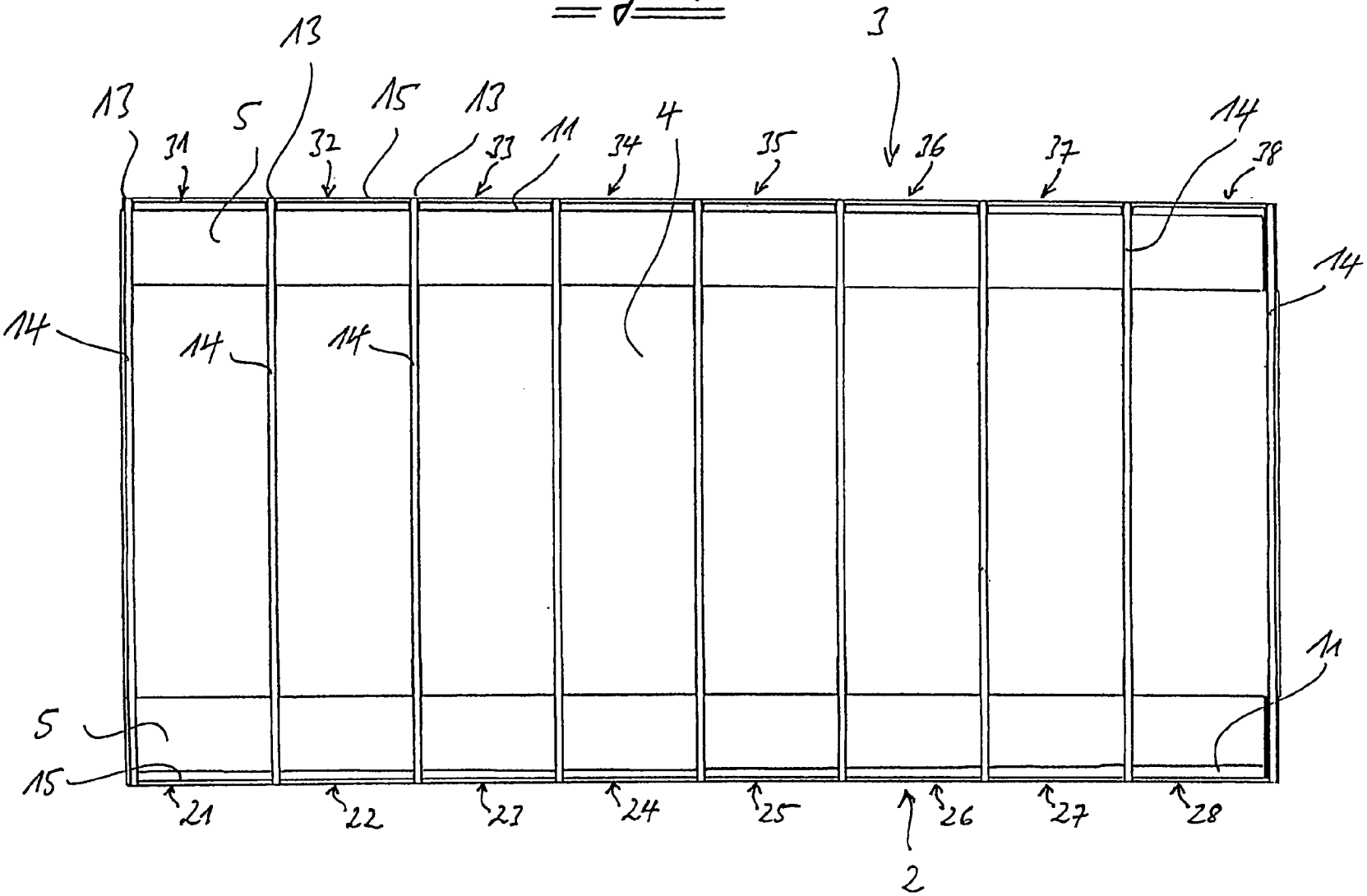
FIG. 4 is a view of the dryer according to the present invention from above.

FIG. 4 is a view of the dryer according to the present invention from above. It shows the cross-beams 14, which extend over the entire dryer width as well as the width of the floor area 5 on the left and right sides. The upper crossbar is seen on both sides of the dryer. Apart from the vertical connecting rods 13 recognisable only in passing, the bearer 11 is visible extending in the longitudinal direction of the dryer for the floor area 5 (see FIG. 1).

Figure 5:
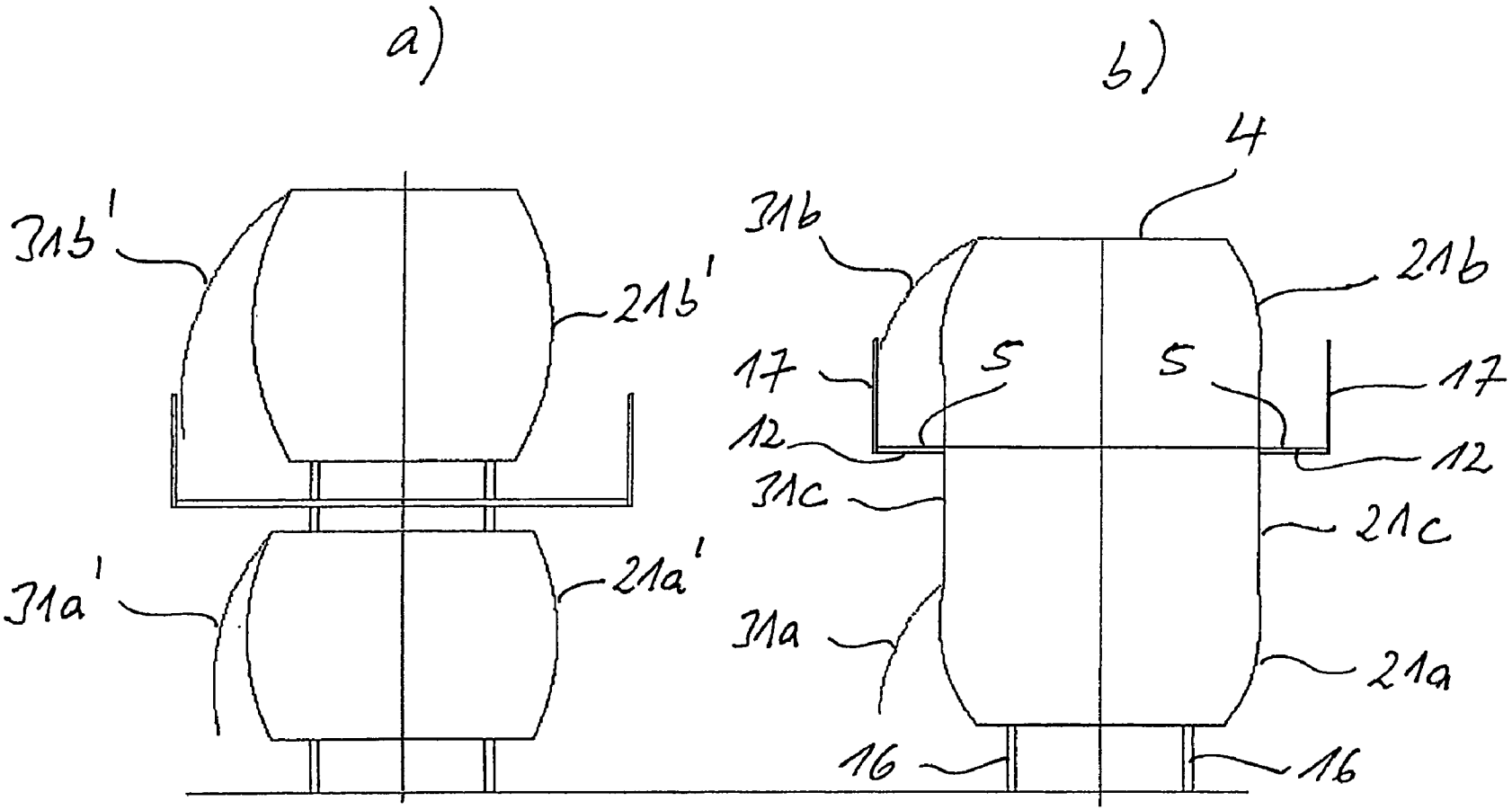
FIG. 5*a* and FIG. 5*b* are comparative views of a dryer of the prior art (FIG. 5*a*) and the dryer according to the present invention (FIG. 5*b*).

FIG. 5 is a comparative juxtaposition of a dryer of the prior art shown in FIG. 5*a* and of the dryer according to the present invention, as per FIG. 5*b*.

And whereas with the dryer according to the prior art as per FIG. 5*b* the upper dryer interior 9' and the lower dryer space 10' are contained in each case in a closed dryer housing, the dryer according to the present invention in FIG. 5*b* comprises only one dryer housing, whose interior is divided by a (not shown) partition into an upper dryer interior 9 and a lower dryer interior 10. The dryer according to the present invention is distinguished by a more compact structure compared to the dryer of the prior art.

In the dryer of the prior art according to FIG. 5*a* the flaps 21*a*', 31*a*' and 21*b*' and 31*b*' in each case extend over the entire height of the lower or upper dryer housing from the upper edge to the lower edge of the housing. On the one hand therefore they are heavy and undergo substantial deflexions due to fluctuations in temperature. With the dryer according to the present invention as per FIG. 5*b* the flaps formed by the lower vertical segments 21*a* and 31*a* as well as the upper vertical segments 21*b* and 31*b* are only half as large, as they do not extend over the entire height of the lower or upper dryer space 10 or 9. Due to the flat areas 21*c* and 31*c* according to the present invention of the right and left side wall 2 or 3 of the dryer and due to the provision of the floor area 5 protected by a railing 17 on both sides of the dryer similar access conditions and above all conditions made easier for a maintenance technician result both for the lower dryer interior 10 and for the upper dryer interior 9.

As is also seen from FIGS. 5*a* and 5*b*, inventive configuration of the dryer (FIG. 5*b*) brings further reduction in the surface/volume ratio of the dryer. This leads to minimal loss of radiated heat and material savings and thus to minimal operating or manufacturing costs (power or material savings).

What is claimed is:

1. A dryer for the continuous flow drying of food products, in particular dough articles, along a continuous flow path of the product inside the dryer with adjustable and/or air-conditioning zones along the continuous flow path of the product, whereby the dryer has an insulating housing (1) with side walls (2, 3) curved in an outer direction, which are divided along the substantially horizontal flow path of the product in each case into individual horizontal segments (21 thru 28 and 31 thru 38), which can be moved away from their closed sealing position from the housing (1) independently of one another, such that the dryer interior is accessible for a maintenance technician, wherein the respective horizontal segments of the side walls are divided perpendicularly to the flow path of the product from top to bottom into at least two vertical segments (21*a* thru 28*a*; 21*b* thru 28*b*; 31*a* thru 38*a*; and 31*b* thru 38*b*), which in each case are curved in an outer direction and can be moved away from the housing (1) independently of one another, so that a maintenance technician has access to the dryer interior at the respective point of a vertical segment moved away from the housing (1).

2. The dryer as claimed in claim 1, wherein on the outside of the housing wall an accessible floor area (5*a*, 5*b*) for the maintenance technician is assigned to each movable vertical segment of the housing wall.

3. The dryer as claimed in claim 2, wherein at least some of the vertical segments adjoining one another along the flow path of the product are assigned a continuous accessible floor area (5*a*, 5*b*).

4. The dryer as claimed in claim 1, wherein the vertical segments are linked by a hinge on the housing (1) and are pivotably moved away from the housing.

5. The dryer as claimed in claim 1, wherein the outward projecting curve of the vertical segments is a one-dimensional bulging with linear generatrix (G).

6. The dryer as claimed in claim 5, wherein the one-dimensional bulging of the vertical segments is designed such that the linear generatrix (G) of the bulged surface are parallel to the flow path of the product and the hinge-like linking is arranged on an upper edge (6) of the vertical segments with an axis of rotation (D) parallel to the linear generatrix (G), wherein the vertical segment can be pivoted upwards as a "flap".

7. The dryer as claimed in claim 5, wherein the one-dimensional bulging of the vertical segments is designed such that the linear generatrix of the bulged surface are orthogonal to the flow path of the product and the hinge-like linking is arranged on a lateral edge of the vertical segment with an axis of rotation running parallel to the linear generatrix, wherein the vertical segment can be pivoted away to the side as a "door".

8. The dryer as claimed in claim 7, wherein the vertical segments can be pressed by at least one tightening strap (7, 8) in their closed position onto the housing (1) to seal, whereby the tightening strap (7, 8) lies on the outside of the vertical segment and the linear generatrix (G) of the bulging cross orthogonally.

9. The dryer as claimed in claim 1, wherein a substantially vertical wall area (21*c* thru 28*c* and 31*c* thru 38*c*) is arranged in a dividing area of the respective horizontal segments from top to bottom between the lower curved vertical segment and the upper curved vertical segment.

10. The dryer as claimed in claim 9, wherein the substantially vertical wall area is a flat wall.

11. The dryer as claimed in claim 9, wherein the dryer interior is divided, at the level of the substantially vertical wall area, into an upper dryer interior (9) and a lower dryer interior (10).

12. The dryer as claimed in claim 11, wherein a separate dryer air-conditioning is adjustable in each of the upper dryer interior (9) and the lower dryer interior (10) in each case.

13. The dryer as claimed in claim 12, wherein at least one mounting area for diverse supply pipes extends along the dryer.

14. The dryer as claimed in claim 13, wherein the at least one mounting area (40) extends along the dryer above the respective vertical segments in one of a ceiling area and below a gallery floor area.

15. The dryer as claimed in claim 14, wherein the accessible floor area on the outside of a housing wall assigned to each movable vertical segment is designed at least for the upper vertical segments of the housing wall as a gallery.

16. The dryer as claimed in claim 15, wherein the gallery-like floor area is borne on bearers (12), which protrude sideways from the dryer.

17. The dryer as claimed in claim 16, wherein the bearers extend transversely to the flow path of the product of the dryer.

18. The dryer as claimed in claim 17, wherein the bearers project on both side walls and the accessible floor area (5) supported on the protruding bearers extends along both side walls (2, 3) of the dryer.

19. The dryer as claimed in claim 18, wherein floor area (5) is supported by connecting rods (13) from above.

20. The dryer as claimed in claim 19, wherein the connecting rods are fixed to cross-beams (14) at the upper end of the dryer.

21. The dryer as claimed in claim 20, wherein the upper end of the dryer has an accessible floor area.

22. The dryer as claimed in claim 20, wherein the connecting rods (13) form with crossbars (15) a railing for the floor area (5).

* * * * *